US006962266B2

(12) United States Patent
Morgan et al.

(10) Patent No.: US 6,962,266 B2
(45) Date of Patent: Nov. 8, 2005

(54) METHOD AND APPARATUS FOR USING A UNIT DOSE DISPENSER

(75) Inventors: Christopher D. Morgan, Woodbury, MN (US); Eddie D. Sowle, Woodbury, MN (US); Tareasa L. Bradley, Inver Grove Heights, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/674,050

(22) Filed: Sep. 29, 2003

(65) Prior Publication Data

US 2004/0065670 A1 Apr. 8, 2004

Related U.S. Application Data

(60) Provisional application No. 60/416,497, filed on Oct. 4, 2002.

(51) Int. Cl.[7] ..... G07F 11/66
(52) U.S. Cl. ..... 221/25; 221/72
(58) Field of Search ..... 221/25, 71, 72, 221/70; 206/528, 531

(56) References Cited

U.S. PATENT DOCUMENTS

| | | | | |
|---|---|---|---|---|
| 3,410,450 A | * | 11/1968 | Fortenberry | 221/7 |
| 3,680,736 A | | 8/1972 | Viessmann | |
| 4,356,099 A | * | 10/1982 | Davies et al. | 510/297 |
| 4,405,060 A | | 9/1983 | Hsei | |
| 5,035,237 A | | 7/1991 | Newell et al. | |
| 5,102,008 A | | 4/1992 | Kaufman et al. | |
| 5,230,441 A | | 7/1993 | Kaufman et al. | |
| 5,348,158 A | | 9/1994 | Honan et al. | |
| 5,489,025 A | | 2/1996 | Romick | |
| 5,630,347 A | | 5/1997 | Elvio | |
| 5,829,085 A | | 11/1998 | Jerg et al. | |
| 5,873,360 A | | 2/1999 | Davies et al. | |
| 5,909,822 A | | 6/1999 | George et al. | |
| 6,014,969 A | | 1/2000 | Lloyd et al. | |
| 6,155,424 A | | 12/2000 | Dubach | |
| 6,425,888 B1 | | 7/2002 | Embleton et al. | |
| 6,540,081 B2 | | 4/2003 | Balz et al. | |

FOREIGN PATENT DOCUMENTS

| | | | |
|---|---|---|---|
| DE | 38 32 049 A1 | | 3/1990 |
| DE | 38 38 144 A1 | | 5/1990 |
| EP | 0 903 405 A2 | | 3/1999 |
| EP | 1 174 363 A1 | | 1/2002 |
| WO | WO 02/058528 A1 | * | 1/2002 |
| WO | WO 02/36188 A2 | | 5/2002 |
| WO | WO 02/36189 A1 | | 5/2002 |
| WO | WO 02/058528 A1 | | 8/2002 |

* cited by examiner

*Primary Examiner*—Kenneth Noland
(74) *Attorney, Agent, or Firm*—IPLM Group, P.A.

(57) ABSTRACT

A method and apparatus for dispensing a unit dose product (11) from a unit dose package (10) is disclosed. The unit dose package (10) includes a first continuous strip (12) operatively connected to a second continuous strip (13) so as to provide individual segments (17) containing the unit dose of product (11). The unit dose of product (11) is dispensed by suitable method which separates the strips (12, 13) and dispensing the unit dose of product (11).

5 Claims, 1 Drawing Sheet

FIG. 1
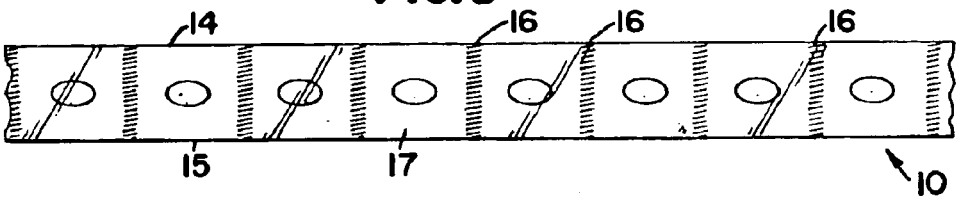
FIG. 2
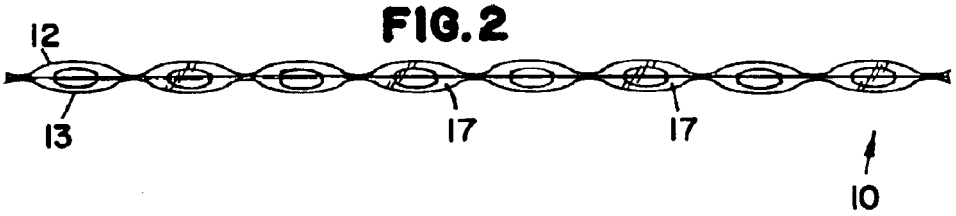
FIG. 3
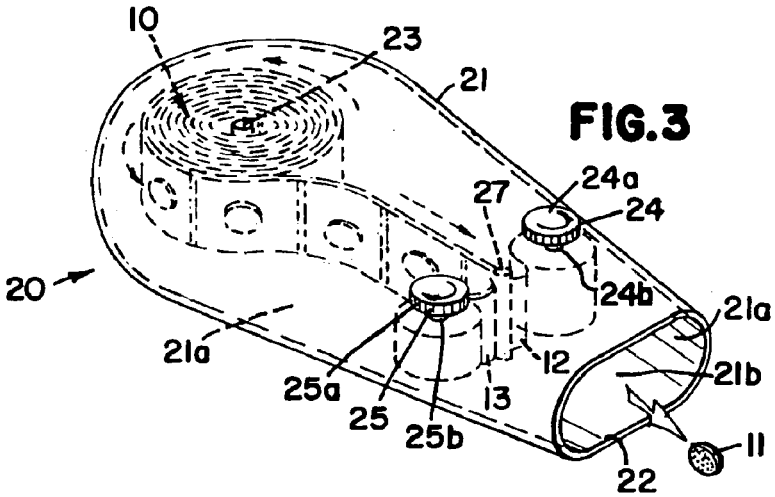
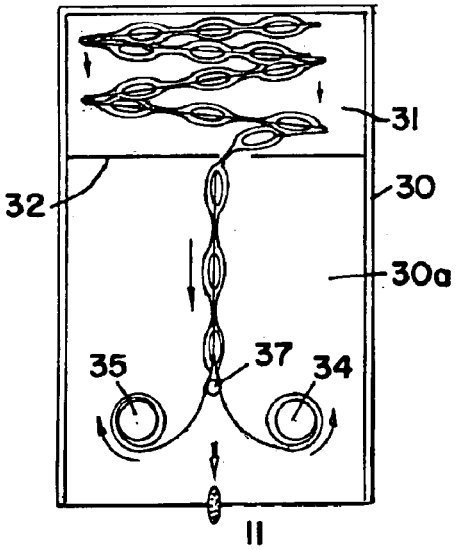
FIG. 4
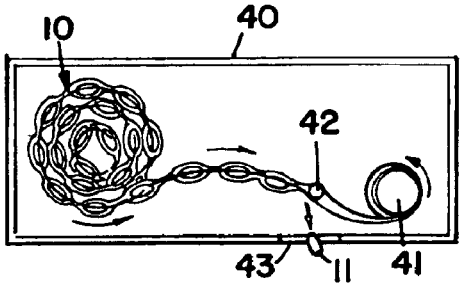
FIG. 5

METHOD AND APPARATUS FOR USING A UNIT DOSE DISPENSER

The present invention claims priority from provisional patent application Ser. No. 60/416,497 filed Oct. 4, 2002 entitled "Method and Apparatus for Using a Unit Dose Dispenser".

BACKGROUND OF THE INVENTION

1. Field of the Invention

This invention relates generally to an apparatus and method for the use of chemicals for use in an aqueous solution and also to a cassette for dispensing the product from a continuous strip of packaging.

2. Description of the Prior Art

The automated system for delivery of a unit dose product for a specialty chemical used in a cleaning or sanitizing process, of product, such as detergent, rinse aid or sanitizer to an end use, such as warewashing apparatus involves many considerations. It is necessary to protect the product from the environment which is typically a hot and humid environment. When used in this application, a "product" shall mean a specialty chemical used in a cleaning or sanitizing process. Further, several products should not be touched by the operator. Also, it is difficult to accomplish the dispensing of certain products where there is a need to provide proper ventilation. Also, it is often important to make certain that sufficient product is utilized as well as that the product is in fact dispensed into the warewashing apparatus or other containers of an aqueous solution.

The present invention addresses the problems associated with the prior art and provides for a unit dose of product that is protected from the environment and is easily dispensed and can be monitored for delivery.

SUMMARY OF THE INVENTION

In one embodiment, the invention is a method of dispensing a product into a device having a diluent. The product is enclosed between two continuous strips forming a plurality of unit doses. The method includes separating the two strips to release a first unit dose. The first unit dose is allowed to fall into the device and the first unit dose is mixed with the diluent. The device advances a second unit dose for subsequent dispensing.

In another embodiment, the invention is a unit dose product for use with a dishwasher. The unit dose includes a first continuous strip layer operatively connected to a second continuous strip layer. A plurality of product doses are positioned between the first and second layers. A plurality of dividers are positioned between the plurality of product doses to form a plurality of unit doses of product.

In another embodiment, the invention is a replaceable container for use with a device having a diluent. The container comprises a housing having an inner cavity and an exit opening. A holding area is provided for storing a continuous strip having a plurality of unit doses of product. The continuous strip includes a first continuous strip layer operatively connected to a second continuous strip layer. A take-up member is utilized for accumulating the continuous strip after the unit doses have been released and exit the exit opening.

BRIEF DESCRIPTION OF THE DRAWINGS

FIG. 1 is a perspective view of a portion of the packaging used to deliver a unit dose according to the present invention;

FIG. 2 is a side elevational view of the package shown in FIG. 2;

FIG. 3 is a perspective view of a dispenser utilized to dispense the packaging shown in FIG. 1;

FIG. 4 is an alternative embodiment showing the packaging accumulated in accordance with another aspect of this invention; and FIG. 5 is another embodiment of a dispenser for use with the packaging shown in FIG. 1.

DETAILED DESCRIPTION OF A PREFERRED EMBODIMENT

Referring to the drawings, wherein like numerals represent like parts throughout the several views, there is generally disclosed at 10 a unit dose package for enclosing a plurality of unit dose of products 11. The unit dose package 10 comprises a first continuous strip 12 operatively connected to a second continuous strip 13. The strips 12, 13 are sealed along their edges 14, 15 as well as by dividing seals 16 after a unit dose of product 11 is placed in each segment 17 that is formed. This process may be done by any means well known in the packaging art. The strips 12, 13 may be any suitable plastic such as a polyolefin. Besides plastics, the strips may be made from a foil, paper backing or other suitable material, Further, the strips 12, 13 may be made from the same material or may also be from different material. The strips 12, 13 are preferably formed of a material that protects the unit dose of product 11 from the possible hot and humid environment in which the unit dose package 10 is utilized. The unit dose of product 11 may be any product which needs to be dispensed, such as a detergent, sanitizer or rinse aid. Further, the unit dose of product 11, while shown in a tablet form in the drawings, could also be a powder or liquid. The unit dose package 10 provides for the dispensing of the unit dose of product 11 without the need for a vent, without the necessity of the operator touching the product 11 and also provides for an accurate dose each time.

It can therefore be seen that the unit dose of package 10 is an elongate strip which includes a plurality of unit doses of product 11. The product 11 may be dispensed into a suitable environment into a secondary device such as into a dishwasher, sink or mop bucket. It may be used with any suitable devices which utilize a diluent, such as water to dissolve and/or dilute the unit dose of product 11. The product 11 may be many different chemicals that need to be diluted by a diluent. Examples of active ingredients are pH modifiers, surfactants, enzymes, builders, lime away products, hydrotropes, metal salts, soil suspending agents, soil flocculating agents, soil release agents, oxidizers, reducing agents, threshold agents, corrosion inhibitors, defoaming agents, catalysts and components or rinse aids, detergents and sanitizers.

While the package 10 has been described as having two strips 12, 13, it is understood additional strips may be utilized. For instance, there may be a thicker protective strip added. The thicker protective strip would allow the inner strip to be thinner, and therefore more easily separated or punctured.

The unit dose package 10 can be stored in multiple ways. Two possible ways are shown in the drawings. The first is in FIG. 3 where the unit dose package 10 is shown in a rolled-up condition. The other is shown in FIG. 4 where the unit dose package is in a folded-up or accordion style condition.

One example of dispensing the unit dose package 10 is shown in FIG. 3. A replaceable container 20 includes a housing 21 that has a cavity 21*a*. The housing 21 has an open end, forming an exit opening 22. The inner cavity 21*a* forms a holding area for storing the continuous strip of unit dose package 10. A pin 23 is secured to the housing 20 and the rolled-up unit dose package 10 is placed over the pin 23. Take-up reels 24, 25 include a rotatable knob 24*a*, 25*a* which are connected to a pin 24*b*, 25*b*. The unit dose package 10 is made such that the end of the package 10 is not sealed so that the strip 12 may be wound around the pin 24*b* and the strip 13 wound around the pin 25*b*. To dispense the product 11, the knobs 24*a*, 25*a* are rotated in opposite directions and the continuous strip of plastic 12, 13 are accumulated on the take-up reels 24, 25. The product 11 then removed from the package 10 and the product 11 is allowed to fall out of the exit opening 22. A pin 27 is positioned to aid in the separation of the strips 12, 13 by having strip 12 on one side of the pin 27 and strip 13 on the other side of the pin 27. The replaceable container 20 is used in a vertical position. It is understood that if the exit opening 22 was on the wall 21*b*, the container 10 could be in a horizontal position. This would provide for a lower profile. It can be seen that the take-up rolls 24, 25 pull on the rolled-up unit dose package 10 stored around the pin 23, the two strips of plastic 12, 13 are pulled apart exposing one product 11 at a time. The product 11 then falls by gravity out of the container 20. It is preferred that the replaceable container 10 be supplied as a complete unit so that there is no need to handle the unit dose package 10 by the operator. The replaceable container 20 is simply replaced when it is empty. While it is preferred that the strips be separated to release the product, it is understood that the separation may also include puncturing of one of the strips, to allow the product to be dispensed.

The advancement of strip of the unit dose package 10 will dispense on unit dose of the product 11 and advance the next unit dose for subsequent dispensing. Preferably, this is done simultaneously, but may also be done sequentially. The continuous strips 12 and 13 are of any suitable length to provide for a plurality of unit doses. One limitation is the size of the housing in which the package 10 is stored. While any number of unit doses may be in the package 10, it has been found that the package 10 can hold from 10 to 5,000 or more unit doses, thereby providing for multiple uses before needing to be replaced. Fewer doses may also be used. The number of doses in the package 10 will be dependent on the size of the product 11 and the application.

Another embodiment of a replaceable container 30 is shown schematically in FIG. 4. The replaceable container 30 has a plurality of product 11 stored in an accordion fashion in the holding area 31. The holding area 31 is separated from the rest of the cavity 30*a* by a wall 32. The wall 32 has an opening through which the unit dose package is supplied. There are again two take-up reels 34, 35 that separate the strips of plastic 12, 13 and are used to accumulate the used strips of plastic 12, 13. The unit dose of product 11 is then dispensed through an exit in the container 30. The container 30 has a pin 37 that will aid in the separation of the strips of plastic 12, 13.

Another embodiment of a replaceable container 40 is schematically shown in FIG. 5. In the replaceable container 40, there is only one take-up reel 41. The take-up reel 41 winds up both of the used strips 12, 13. The unit dose package 10 is shown in a rolled condition, although it is understood that it may also be in an accordion style, as shown in FIG. 4. The product 11 is separated from between the strips of plastic 12, 13 as the take-up roll 41 is rotated. A pin 42 assists in separating the strips of plastic 12, 13 and the product 11 exists an exit opening 43.

Another dispenser that could be utilized is one where a piston or roller would force the product 11 out through one of the strips 12, 13. This would also use only one take-up reel, as the strips 12, 13 would not be separated.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of dispensing a product into a device having a diluent, the product enclosed between two continuous strips forming a plurality of unit doses, comprising:

a) the product is selected from the group consisting of a detergent, sanitizer and rinse aid;

b) separating the two strips to release a first unit dose;

c) allowing the first unit dose to fall into the device;

d) advancing a second unit dose for subsequent dispensing; and e) mixing the first unit dose with the diluent.

2. The method of claim 1, wherein the device is selected from the group consisting of a sink, bucket and dishwasher.

3. The method of claim 1, wherein the diluent is water.

4. The method of claim 1, wherein advancing a second unit dose and allowing the first unit dose to fall are done simultaneously.

5. The method of claim 1, further comprising rolling up the strips after each unit dose falls from the strips.

* * * * *